US006374066B1

(12) United States Patent
Smith et al.

(10) Patent No.: US 6,374,066 B1
(45) **Date of Patent: *Apr. 16, 2002**

(54) ARCUATE SURFACE APPARATUS DESIGN METHOD

(75) Inventors: James B. Smith; Donald A. Brown, both of Honeoye Falls; Kenneth J. Rieck, Victor, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/342,870

(22) Filed: Jun. 29, 1999

(51) Int. Cl.[7] ..... G03G 15/00

(52) U.S. Cl. ..... 399/107; D18/36; D18/44; 399/110; 399/393

(58) Field of Search ..... 399/107, 110, 399/377, 379, 380, 361, 390, 393; D18/36, 37, 40, 44, 46, 50; 264/239; 347/138, 152; 358/401, 501, 296

(56) References Cited

U.S. PATENT DOCUMENTS

| | | | | | |
|---|---|---|---|---|---|
| 4,227,800 | A | * | 10/1980 | Nezu | 399/361 X |
| D334,400 | S | | 3/1993 | Penke et al. | D18/39 |
| D335,682 | S | | 5/1993 | Penke et al. | D18/49 |
| D344,973 | S | | 3/1994 | Penke et al. | D18/39 |
| 5,414,492 | A | * | 5/1995 | Kubota | 399/111 |
| 5,826,153 | A | * | 10/1998 | Hazama et al. | 399/111 X |
| 5,881,340 | A | * | 3/1999 | Stickney et al. | 399/110 |
| 5,884,132 | A | * | 3/1999 | Gotham et al. | 399/393 |
| 5,887,239 | A | * | 3/1999 | Hong et al. | 399/405 |
| 5,974,298 | A | * | 10/1999 | Urban et al. | 399/390 X |
| D425,931 | S | * | 5/2000 | Brown et al. | D18/44 |
| 6,078,765 | A | * | 6/2000 | Takano et al. | 399/107 X |

* cited by examiner

*Primary Examiner*—Sophia S. Chen
(74) *Attorney, Agent, or Firm*—Annette L. Bade

(57) ABSTRACT

A method for forming an arcuate surface on at least one key feature part of an apparatus defining an arcuate surface extending from one end of the key feature part to another end of the key feature part.

18 Claims, 4 Drawing Sheets

ARCUATE SURFACE APPARATUS DESIGN METHOD

CROSS REFERENCE TO RELATED APPLICATIONS

Reference is made to copending U.S. Design Applications entitled, "PAPER DRAWERS FOR AN ELECTROSTATOGRAPHIC MACHINE," U.S. application Ser. No. 29/107,201, filed Jun. 29, 1999. entitled, "CONTROL PANEL FOR AN ELECTROSTATOGRAPHIC MACHINE," U.S. application Ser. No. 29/107,204, filed Jun. 29, 1999. entitled, "PAPER TRAYS FOR AN ELECTROSTATOGRAPHIC MACHINE," U.S. application No. 29/107,205, filed Jun. 29, 1999.

BACKGROUND OF THE INVENTION

The present invention relates to design strategies and processes thereof. More specifically, the design strategies are useful in designing signature electrostatographic reproducing apparatuses, including digital, image on image and contact electrostatic printing apparatuses. The design provides a line or family of machines which communicate signature designs using a common symbolic visual design language. Design strategies help achieve customer satisfaction and corporate design process leverages. In addition, some of the key basic features containing the signature designs are also user friendly, thus enhancing productivity and operator comfort by placing control panels and paper tray access areas in a highly cognitive and antropometric/ergonomic position for operator efficiency. In preferred embodiments, a signature design including an arcing design using arcuate surfaces is carried throughout a line or family of machines.

SUMMARY OF THE INVENTION

Embodiments of the present invention include: a method for forming signature arcing on at least one key feature part of an apparatus comprising: forming at least one key feature part of an apparatus to define an arcuate surface extending from one end of the key feature part to another end of the key feature part.

In addition, embodiments include: an apparatus formed by a method for forming signature arcing on at least one key feature part of the apparatus comprising: forming at least one key feature part of the apparatus to define an arcuate surface extending from one end of the key feature part to another end of the key feature part.

Embodiments also include: an electrostatographic machine formed by a method for forming signature arcing on at least one key feature part of the machine comprising: forming at least one key feature part of the machine to define an arcuate surface extending from one end of the key feature part to another end of the key feature part.

BRIEF DESCRIPTION OF THE DRAWINGS

For a better understanding of the present invention, reference may be had to the accompanying figures.

DETAILED DESCRIPTION OF THE PRESENT INVENTION

Figure 1:
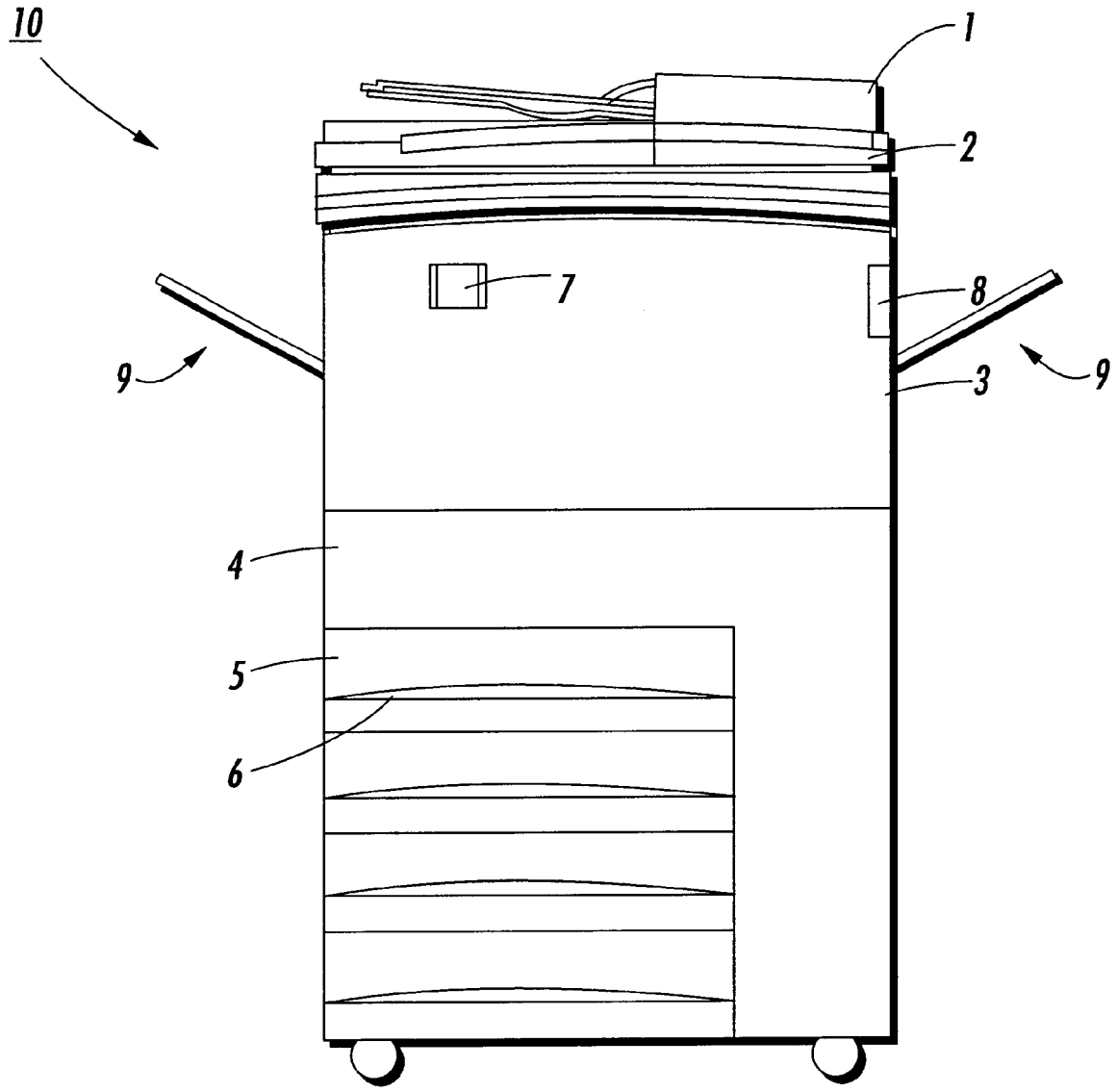
FIG. 1 is a frontal view of a mid-volume machine, wherein the paper drawers are all of equal length.

The design strategies are useful in designing signature apparatuses, such as electrostatographic reproducing apparatuses, including digital, image on image and contact electrostatic printing apparatuses. The design strategies provide a line or family of machines which communicate signature designs using a common symbolic visual design language. The overall design includes the capturing and repeating of signature designs located at strategic positions of each machine in the line or family of products. The repetition of a signature design allows for a customer to relate the machines to one global family of products originating from the same source. Some of the signature designs are also user friendly, providing a machine that is much easier for the customer to use. The signature design is flexible and provides for a decrease in unit manufacturing costs.

Examples of apparatuses or machines which can be included in the family of products which possess the design strategy include electrostatographic apparatuses such as scanners, printers, copiers, multi-function, and facsimile machines. The signature design is flexible enough to be processed into small, medium and large scale machines including small office/home office machines, desktop machines, convenience machines, workgroup machines, production machines, engineering large format copiers, printers, scanners, and the like. The signature elements can also be encompassed onto the any visual view of the machine such as front of the machines, sides of machines, top of machines and back of the machines.

Specific examples of signature designs include arcs, gaps, ribs, radii, digital texture, and angled surfaces. A signature design which is captured in each of the apparatuses or machines is the signature arc located at strategic parts or key feature parts of each of the machines of the family. In a preferred embodiment, the signature arcs form an indentation, are user friendly and allow for easier use of the machine by the customer.

Specifically, the signature arcs are arcuate surfaces formed on various key feature parts of the apparatuses or machines. Key feature parts are parts of a machine that are visible from the outside and which are parts that are present on similar machines or machines of a like nature, such as electrostatographic machines. The key feature parts of an electrostatographic machine include entry paper trays which may be located on the front, either side or back of the machines and preferably the front and either side of the machines; exit paper trays which may be located on the front, either side or back of the machines and preferably the front and either side of the machines; paper drawers which may be located on the front, either side or back of the machines and preferably the front and either side of the machines; platen covers which may be located on the top, front, sides, or back of machines, and is usually located on the top of the machine; document handlers which are usually located on the top or front of the machine; logos or badges which may be located at any part of the machines, but preferably are located on the front of the machine, and particularly are located in the front of the machine on a front panel located above the paper drawers; and like key feature parts.

It is preferable that the signature arc be evident to a user from a distance of about 20 feet or more from the machine. It is further preferable that the signature arc extend along the entire length of the key feature part. Examples of arcuate surfaces on key feature parts are set forth in FIGS. 1 and 2, wherein a mid-volume printer is shown, and wherein the arcuate surface is present on the platen cover, the document handler, and on all four of the paper drawers. The arcs on the paper drawers depicted in FIGS. 1 and 2 include an indentation allowing for the customer to grasp the drawer and open/close with ease. The paper drawers are movable in and out of the machine to enable the user to refill paper or other supplies therein. Therefore, not only does the drawer arcing provide an identifiable feature, the drawer arc enables ease of use of the machine. Although not depicted in FIGS. 1 and 2, an arcuate surface extending along the platen cover can also be indented in order to allow the customer to grasp the platen cover and lift it to open/close with ease. The platen cover is capable of pivoting up and down so as to lift, place a sheet to be copied or faxed or scanned on the platen, and close the platen cover to perform the requisite function of the machine. The arcuate surface on the document handler can also be indented to allow for easy use by the customer. Control panel features and buttons following an arcuate surface allow for a more natural and ergonomic position for users and customers to rest their hands, which in turn, allowing for reduced user fatigue and strain.

Figure 2:
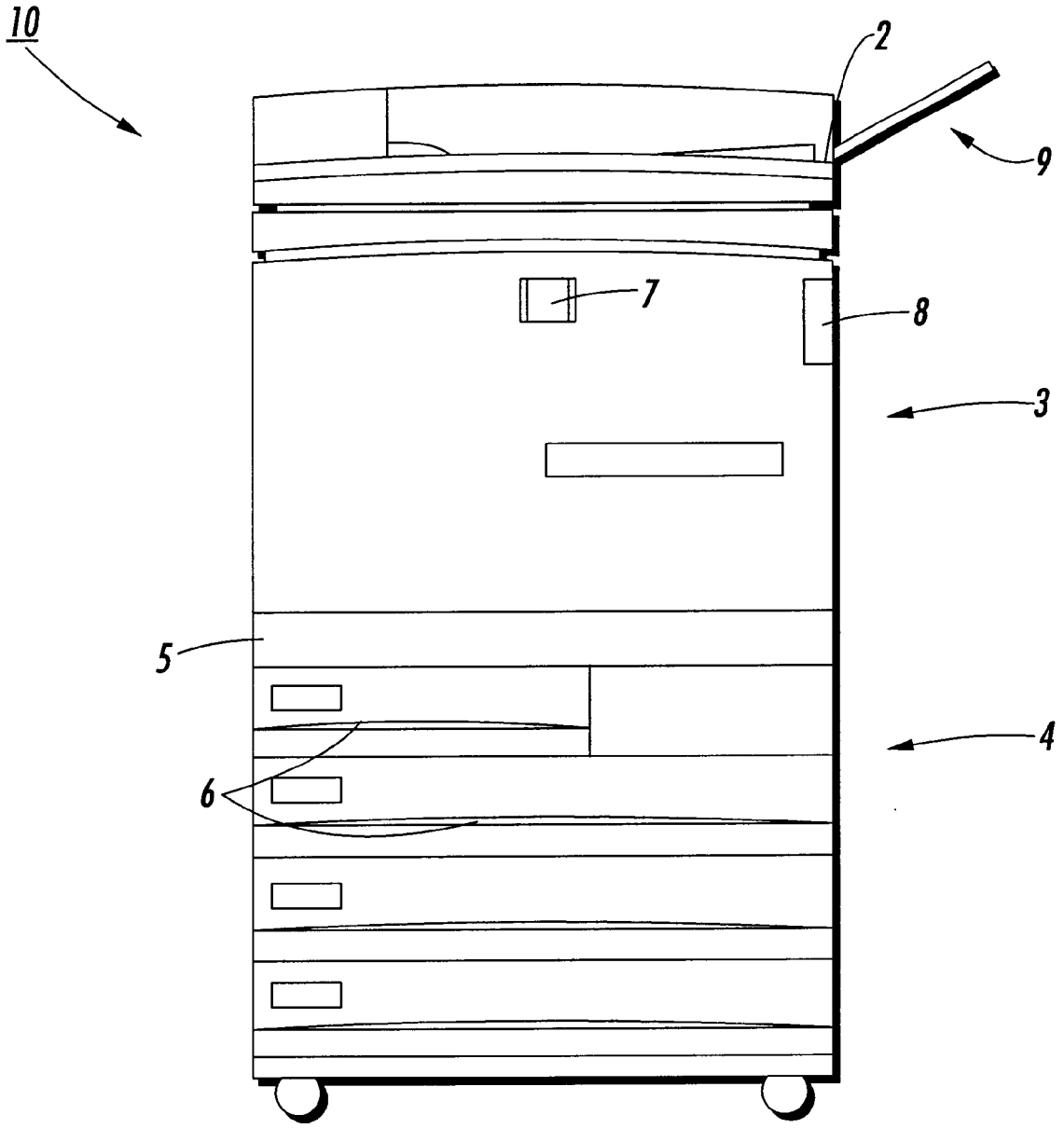
FIG. 2 is a frontal view of a mid-volume machine, showing paper drawers of different lengths.

FIGS. 1 and 2 demonstrate some preferred details of an embodiment of the invention and include a frontal view of a mid-volume stand alone machine from a workgroup class of machines. In FIGS. 1 and 2, mid-volume machine 10 comprises document support compartment 4 and main body 3. Present on main body 3 is platen cover 2 and document handler 1 (FIG. 2 does not depict a document handler). Main body 3 optionally houses a company logo 7 and indented area 8 which opens a side drawer or opens the main body compartment for working on the inner components of the machine (not shown). In addition, main body houses paper trays including entry and/or exit paper trays. Shown in FIGS. 1 and 2 are positions where side paper trays 9 can be located on either side of the main body 3 of the machine of FIG. 1, and located on one side of the main body 3 of the machine depicted in FIG. 2. Paper trays 9 are movable. In a preferred embodiment, paper trays house an indented arcuate surface for ease of moving the paper tray in and out of the machine in order to load paper or change paper types. Paper drawers 5 are located in document support area 4, and include a signature arc or arcuate surface 6. Arcuate surface 6 is preferably indented to ease customer handling of the paper drawers. FIG. 1 depicts an embodiment wherein all paper drawers are of relatively the same shape. FIG. 2 depicts an alternative embodiment wherein at least one of the paper drawers is smaller than the others.

Figure 3:
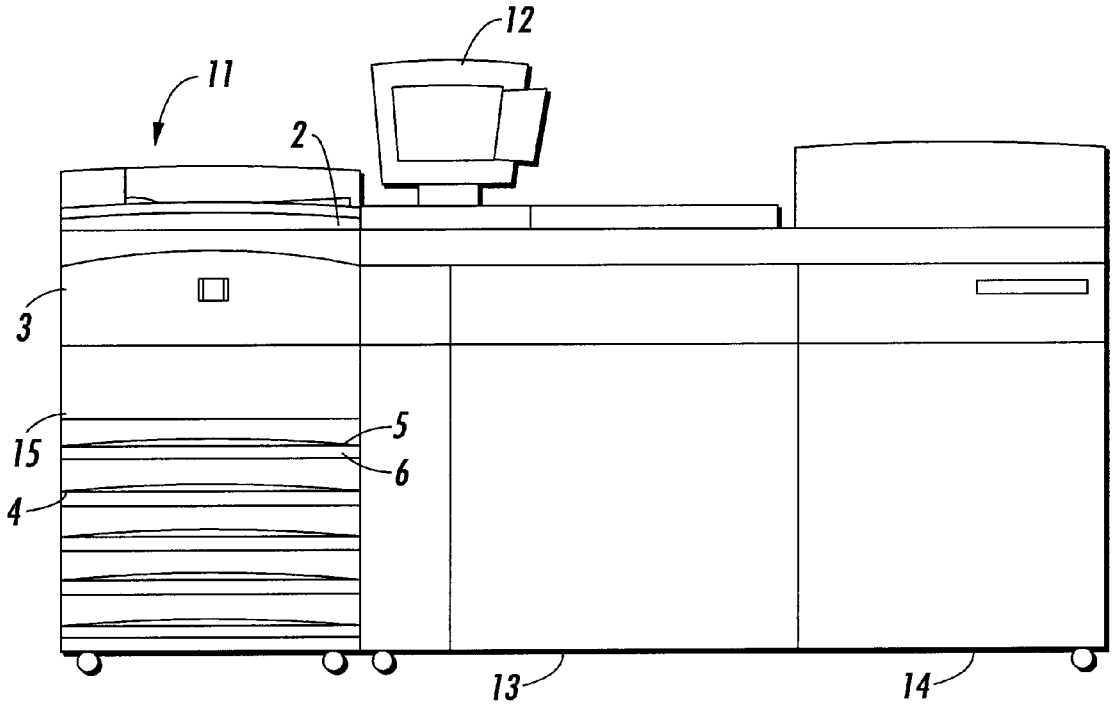
FIG. 3 is a frontal view of a large-volume machine.

FIG. 3 is a frontal view of a large-volume photocopy machine 11 which comprises input terminal 15, input/output terminal 13 and finishing terminal 14. Input terminal 15 comprises main body 3, document support area 4, and platen cover 2 positioned on main body 3 having signature arc or arcuate surface 6 are located in document support area 4. Also shown in FIG. 3 is graphic user interface 12.

FIG. 3 demonstrates the signature arc located on the paper drawers and the platen cover also.

Preferably, the arcuate surface extends along the entire length of the key feature part. Therefore, the length of the arc depends on the length of the key feature part. Also, preferably, the slope of the arcuate surface is from about 500 millimeters to about 10,000 millimeters radius, and preferably from about 1,000 millimeters to about 5,000 millimeters. The arcuate surface preferably has a rise of from about 5 to about 25 millimeters, preferably from about 10 to about 15 millimeters. The maximum rise is the distance from the horizontal to the mid-point of the arc.

Arcuate surfaces are located on at least one key feature part. In a preferred embodiment of the invention wherein arcs are located on more than one key feature part, or an embodiment wherein the arcs are located on both the document handler and on the platen cover, it is preferred that the arcs be concentric or visually related. Concentric refers to having the same center point of a circle.

Figure 4:
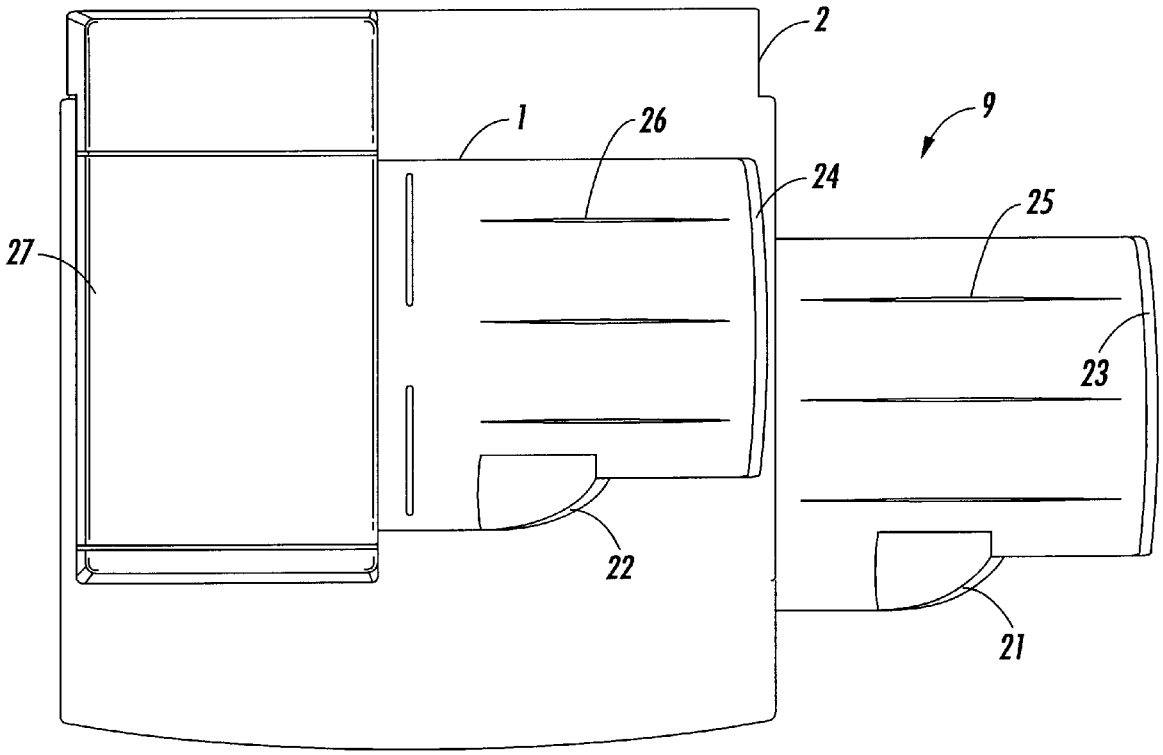
FIG. 4 is an elevated view of a document handler and paper tray.

In a preferred embodiment, paper trays may also comprise the signature arc or arcuate surface. The arc may be flush with an end of the paper tray, or may be extensions of the paper tray. In a preferred embodiment, the paper tray comprises another smaller arching feature on the side of the tray facing the front side of the machine. FIG. 4 demonstrates an example of arching of a paper tray at an end, and at a side part of the tray. FIG. 4 depicts a top view of a paper tray. Specifically, in FIG. 4, paper tray 9 extends from the side of a machine (not shown). Paper tray 9 can be present on either side of the machine, or elsewhere. Further, paper tray 9 can include entry and exit paper trays. Document handler 1 is positioned on platen cover 2 on top of a machine (not shown) and in contact with document processor 27. Paper tray 9 and document handler 1 comprise arcuate surfaces 23 and 24, respectively. Another embodiment is shown in FIG. 4, wherein arcuate surfaces 23 and 24 of key feature elements paper tray 9 and document handler 1, respectively, are not concentric. Paper tray 9 and document handler 1 also include ribs 25 and 26, respectively. Paper tray ribs keep paper from developing static electricity and sticking to the surface of the paper tray. Tray ribs are extremely important in high page per minute machines. Access scoop 21 and 22 of paper tray 9 and document handler 1, respectively, also include an arcuate surface. In addition, access scoops 21 and 22 include an indentation to allow the user to grasp the key feature part and remove it from the machine.

The arcuate surface can be formed by a variety of manufacturing processes including known plastic molding techniques or sheet metal fabrication methods.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A method for forming signature arcing on at least two key feature parts of an electrostatographic apparatus comprising:

molding at least two key feature parts of an apparatus to define arcuate surfaces, one of each of said arcuate surfaces extending from one end of one of each of said key feature parts to another end of one of each of said key feature parts, and said arcuate surfaces extending along entire widths of said key feature parts, wherein said at least two key feature parts are concentric, and wherein each of said arcuate surfaces defines an indentation in at least two of said key feature parts.

2. A method in accordance with claim 1, wherein each of said arcuate surfaces has a slope of from about 500 to about 10,000 millimeters radius.

3. A method in accordance with claim 2, wherein each of said arcuate surfaces has a slope of from about 1,000 to about 5,000 millimeters radius.

4. A method in accordance with claim 1, wherein each of said arcuate surfaces has a rise of from about 5 to about 25 millimeters.

5. A method in accordance with claim 1, wherein each of said arcuate surfaces has a rise of from about 10 to about 15 millimeters.

6. A method in accordance with claim 1, wherein said key feature parts are movable parts.

7. A method in accordance with claim 6, wherein said movable parts comprise a drawer or a cover.

8. A method in accordance with claim 7, wherein said cover is capable of pivoting.

9. A method in accordance with claim 1, wherein said apparatus is a copy machine, a printer, a facsimile machine, or a scanner.

10. A method in accordance with claim 9, wherein said at least two key feature parts comprise a paper drawer, a platen cover, a document handler, and a paper tray.

11. A method in accordance with claim 1, wherein one of said key feature parts is a drawer.

12. An apparatus formed by a method for forming signature arcing on at least two key feature parts of said apparatus comprising:

molding at least two key feature parts of said apparatus to define arcuate surfaces, one of each of said arcuate surfaces extending from one end of one of each of said key feature parts to another end of one of each of said key feature parts, and said arcuate surfaces extending along entire widths of said key feature parts, wherein said arcuate surfaces on said at least two key feature parts are concentric, and wherein each of said arcuate surfaces defines an indentation in at least two of said key feature parts.

13. An apparatus in accordance with claim 12, wherein each of said arcuate surfaces has a slope of from about 500 to about 10,000 millimeters radius.

14. An apparatus in accordance with claim 12, wherein each of said arcuate surfaces has a rise of about 10 to about 15 millimeters.

15. An electrostatographic machine formed by a method for forming signature arcing on at least two key feature parts of the machine comprising:

molding at least two key feature parts of said machine to define arcuate surfaces, one of each of said arcuate surfaces extending from one end of one of each said key feature parts to another end of one of each of said key feature parts, and said arcuate surfaces extending along entire widths of said key are concentric, and wherein each of said arcuate surfaces defines an indentation in at least two of said key feature parts.

16. An electrostatographic machine in accordance with claim 15, wherein each of said arcuate surfaces has a slope of from about 500 to about 10,000 millimeters.

17. An electrostatographic machine in accordance with claim 15, wherein each of said arcuate surfaces has a rise of from about 5 to about 25 millimeters.

18. An electrostatographic machine in accordance with claim 15, wherein said at least two key feature parts comprise a paper drawer, a platen cover, a document handler, and a paper tray.

* * * * *